United States Patent [19]

Washburn

[11] 4,017,086

[45] Apr. 12, 1977

[54] GOLFER'S TRAINING AID

[76] Inventor: Philip J. Washburn, P.O. Box 936, Roseburg, Oreg. 97470

[22] Filed: Nov. 7, 1975

[21] Appl. No.: 629,779

[52] U.S. Cl. ..... 273/183 B; 273/189 R; 273/26 R; 273/29 A

[51] Int. Cl.[2] ..... A63B 69/36

[58] Field of Search ..... 273/189, 183 B, 188 R, 273/186 R, 26 R, 29 A; 35/29 A

[56] References Cited

UNITED STATES PATENTS

| | | | |
|---|---|---|---|
| 717,895 | 1/1903 | McClain | 273/189 R |
| 1,457,710 | 6/1923 | MacDonald | 273/183 B |
| 3,339,926 | 9/1967 | Coupar | 273/183 B |
| 3,350,100 | 10/1967 | Carmines | 273/183 B |
| 3,400,934 | 9/1968 | Muehl | 273/189 A |

*Primary Examiner*—George J. Marlo
*Attorney, Agent, or Firm*—James D. Givnan, Jr.

[57] ABSTRACT

A forearm attached device for retention of the golfer's grip in cocked configuration until the proper release point in the downswing. A ratchet assembly is attachable to the forearm and receives a retention rod pivotally coupled at its opposite end to a retention plate affixed to the back of the golfer's hand. The ratchet assembly permits unobstructed rearward passage of the rod during cocking of the wrist and hand during the backswing and assists in holding the hand cocked until club imparted forces overcome adjustably biased ratchet components which permit rod extraction allowing the golfer's grip to "break" at the proper time. An abutment plate prevents displacement of the ratchet assembly on the arm during rod extraction.

9 Claims, 6 Drawing Figures

GOLFER'S TRAINING AID

BACKGROUND OF THE INVENTION

The present invention relates generally to golfing equipment and more particularly to a device attachable to a golfer's forearm to assist in the training of arm muscles so as to remedy premature breaking of the wrists during the downswing of a golf club.

Of great importance in the execution of a good golf swing is the timely breaking of the wrists from their cocked position during the downward swing of the club. Ideally the wrists are uncocked late in the swing both for purposes of accuracy and to take advantage both of centrifugal force and the conservation of angular motion. Novices are inclined to uncock their wrists prematurely of times resulting in the club head imparting an undesired spin to the ball and desired club head velocity not being attained.

In the normal execution of a wood or iron swing, the right hand of a right handed golfer is cocked or retracted so as the back of the hand is approximately 70 degrees included angle to the forearm axis. The hand is so held by arm muscles during the initial part of the downswing with uncocking of the overlapped hands just prior to ball impact adding speed to the club head. The tendency of inexperienced golfers, largely due to inadequate muscle training, to uncock the wrists early results in an undesired excursion of the club head from the desired arc of travel and, more importantly, results in failure to achieve desired club head speed.

SUMMARY OF THE PRESENT INVENTION

The present invention is embodied within a device which aids the golfer in maintaining the overlapped hands of the golf grip in the cocked position until the optimum release point in the downward swing of the club.

The present device includes a ratchet assembly, serving in conjunction with other components, to retain the wrist of a golfer's dominant hand in a cocked position until a desired release point in the downswing. A hand attached plate moves with the hand with an elongate or rod member extending intermediate the hand attachment and the ratchet assembly to restrict hand movement until the desired release point. In so doing, the device may be said to be an aid to the golfer's arm muscles to help resist centrifugal force acting on the club during its downward movement until an optimum release point.

The device is adjustable both to the physical dimensions of the user as well as to varying degrees of centrifugal force produced in the swings of different golfers and different golf shots.

Important objects of the present invention include: the provision of a training aid for golfers to assist the arm muscles in controlling club travel during its downward swing; the provision of a training aid which, in addition to assisting club control, permits normal arm, wrist and hand movements throughout the golf swing; the provision of a training aid fully adaptable to a wide range of golfers and to golf swing variations for different clubs; the provision of a training aid of lightweight construction so as to not distract the golfer when in place on the arm; and the provision of a training aid facilitating the development of muscle memory for the golfer's arm.

DETAILED DESCRIPTION OF THE PREFERRED EMBODIMENT

Figures 1, 2, 3, 4, 5, 6:
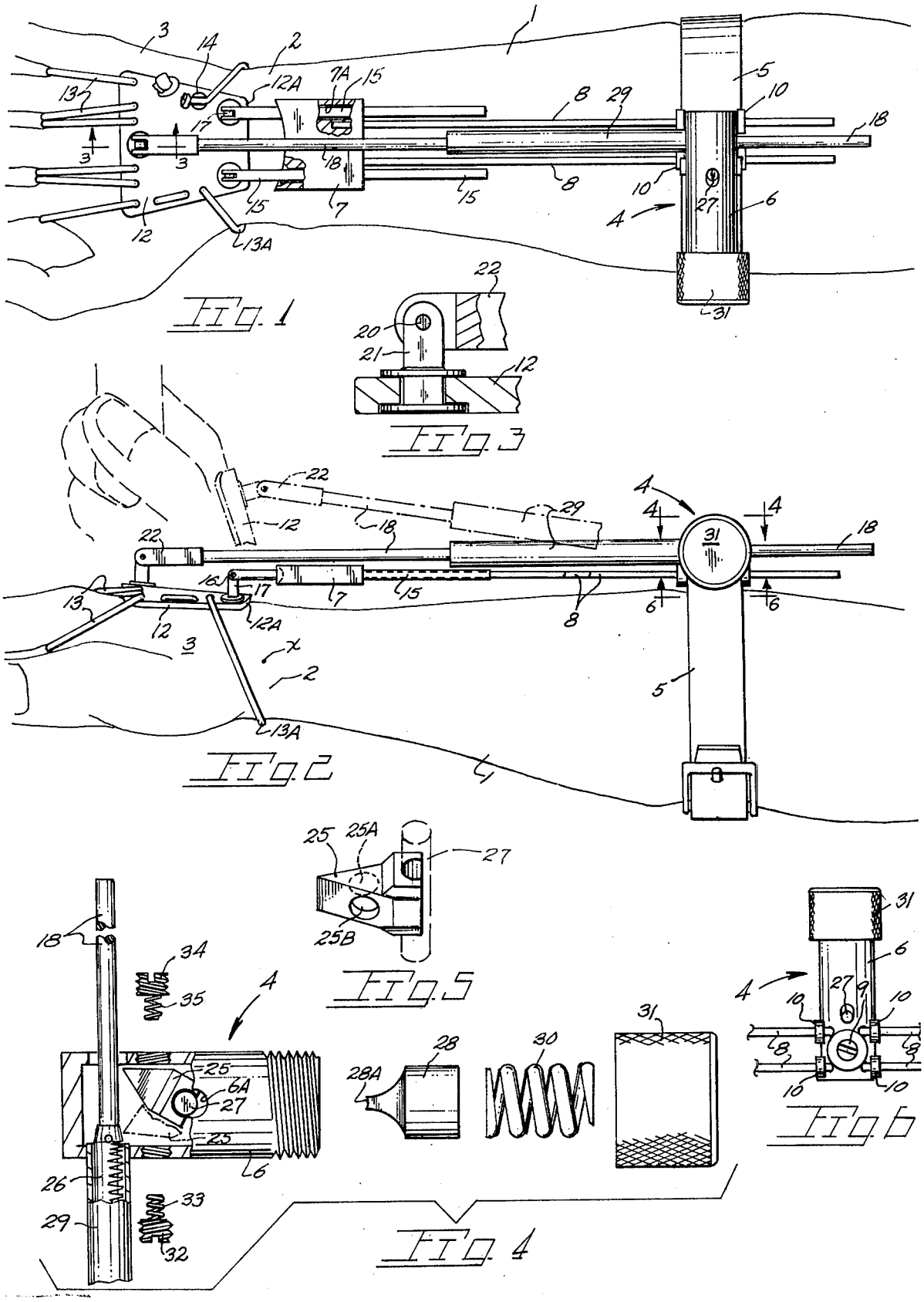
FIG. 1 is a plan view of the present device in place on a right handed golfer's forearm and hand.
FIG. 2 is a side elevational view of FIG. 1 with a cocked right hand shown in broken lines.
FIG. 3 is an enlarged detail view taken along line 3—3 of FIG. 1.
FIG. 4 is an enlarged exploded view of the ratchet assembly taken along line 4—4 of FIG. 2 rotated through ninety degrees.
FIG. 5 is a perspective view of a pawl removed from the ratchet assembly.
FIG. 6 is a bottom plan view of the ratchet assembly taken along line 6—6 of FIG. 2.

With continuing reference to the accompanying drawing wherein applied reference numerals indicate parts similarly identified in the following specification, the reference numeral 1 indicates the forearm of a right handed golfer with the wrist and hand indicated at 2 and 3.

In place on the upper side of the arm is a ratchet assembly indicated generally at 4 suitably mounted as by a buckled strap 5 to the arm as by a fastener at 9 (FIG. 6) extending through the strap and a ratchet assembly housing 6. Details of the ratchet assembly are later elaborated upon.

The ratchet assembly supports an offset abutment plate at 7 which is supported in place adjacent the arm and rearward of wrist 2 by a pair of support rods 8 embedded at their ends within the plate with the remaining rod ends adjustably secured to ratchet housing 6 by means of oppositely disposed pairs of set collars 10 on each rod. Plate 7 and rods 8 serve to prevent forward displacement of the ratchet assembly along the arm during initial unsocking movement of the hands. Rods 8 also support abutment plate 7 in a yieldable manner permitting rotational movement of the wrist about the forearm axis.

A hand retention plate, indicated at 12, is of concave shape on its underside to comfortably fit the convex back side of the hand. Said retention plate is removably mounted on the hand by suitable means such as a length of cord 13 having looped segments through which fingers of the hand pass. A run of the cord at 13A additionally passes below the wrist and terminates in engagement with a slotted holder 14. Accordingly retention plate 12 is detachably affixed to the top of the hand for movement therewith.

Adjacent the rearward edge 12A of hand retention plate 12 are mounted a pair of plate guide rods 15. Each rod is mounted for movement about intersecting axes by means of a pivot pin 16 and a rotatable mounting post 17 similar to the rod mounting arrangement shown in FIG. 3. The guide rods are flexible, as is a later described retention rod, and are preferably of a synthetic resinous material such as nylon. Each rod 15 is in sliding engagement with openings 7A in abutment plate 7 and additionally may flex to permit unhindered, assymetrical movement of hand retention plate 12 both toward and away from abutment plate 7.

As viewed in FIG. 2, hand retention plate 12 moves upwardly and rearwardly during cocking of the hand generally about a wrist axis at X extending transversely through the wrist 2. It is understood that hand movement is actually about plural axes. Such rearward movement is permitted by slidable extensible guide rods 15 and by a flexible retention rod at 18 which extends rearwardly from hand attached plate 12 into engagement with ratchet assembly housing 6. The forward end of retention rod 18 is attached as viewed in FIG. 3 for movement of the rod end about perpendicular intersecting axes by means of a pivot pin 20 and a pivotally mounted, flange equipped post 21 terminating upwardly within a bifurcated rod fitting at 22. Accordingly, retention rod 18 does not hinder assymetrical movement of the hand during cocking of same about axis X.

With regard to the ratchet assembly indicated generally at 4 and best viewed in FIG. 4, the same, as aforementioned, comprises a housing 6 fastened in place on strap 5 by fastener 9. Ratchet means within said housing serves to allow passage of hand retention rod 18 in a rearward direction (to the right in FIG. 1) while providing for adjustable release of the rod in an opposite direction during the downswing of the club. A pawl at 25 engages a rack-like fitting 26 in place on said retention rod to momentarily lock the latter in a retracted position upon cocking of the golfer's wrists at a point in the backswing. A ratchet mounting pin 27 in elongate housing openings 6A permits arcuate movement of the pawl from a locking to a release position shown in full and broken lines respectively. Yieldable ratchet means further includes a keeper 28 having a pin engaging surface 28A biased into engagement with pin 27 by a helical spring 30 and an adjustable threaded cap 31.

To position pawl 25 to the full line, normal position of FIG. 4 I provide a first adjustment screw 32 having a spring element 33 in biased engagement with the pawl. A second adjustment screw at 34 is oppositely disposed from the first adjustment screw on housing 6 and includes a spring element 35 of a lesser rate than spring element 33 whereby, when the pawl is disengaged from rack-like fitting 26 on the retention rod, the pawl will be pre-positioned to rest in the full line position of FIG. 4 to permit rearward, unobstructed passage of fitting 26. Recesses 25A-25B for the ends of spring elements 33 and 35 are formed in the pawl. Tubular guide 29 constrains rod 18 for travel past ratchet 25.

In operation, the device is strapped to the right or left forearm of the golfer with abutment plate 7 adjusted so as to be contacted by the upper ends of posts 17 on hand retention plate 12 during cocking of the hand. As viewed in FIG. 2, uncocking motion of the hand will tend to draw retention rod 18 forward. The tendency of ratchet assembly 4 to follow rod 18 during initial uncocking of the hands is prevented by reason of abutment plate 7 being held in place by the upper ends of rotatable mounting posts 17. Accordingly, the posts upper ends serve as a fulcrum for at least the initial part of the arcuate travel of retention plate 12 during uncocking of the wrists whereafter unrestricted wrist movement may take place. After a period of use, the golfer becomes adept at controlling unaided arm muscles so as to accomplish breaking of the wrists and hands at the optimum point in the downswing.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A device for attachment to a golfer's forearm for the purpose of conditioning arm muscles so as to properly control uncocking of the forearm hand and wrist during the club downswing, said device comprising, a ratchet assembly including an adjustably biased pawl, means attaching said assembly to the forearm, hand retention means in place on the back of said hand for movement therewith, flexible elongate retention means extending rearwardly from said hand retention means into operative engagement with said pawl of the ratchet assembly, an abutment member offset rearwardly from the hand retention means and coupled to said ratchet assembly, said abutment member contacted by said hand retention means when the forearm hand is cocked and thereafter during initial uncocking of the forearm hand to maintain the ratchet assembly in place on the forearm against forces exerted by said elongate retention means.

said ratchet assembly pawl permitting rearward displacement of the elongate retention means during cocking of the forearm hand during the backswing and subsequently holding same against extraction, and said ratchet assembly additionally retaining said elongate and hand retention means in a retracted state until club imparted forces during the downswing overcome the biased pawl of the ratchet assembly resulting in release of the elongate retention means and uncocking of the hand at a desired point in the downswing.

2. The device claimed in claim 1 additionally including guide rods carried by said hand retention means in slidable engagement with said abutment member to assure abutting contact of said hand retention means with the abutment member during cocking and initial uncocking of the forearm hand.

3. The device claimed in claim 2 wherein said elongate retention means and said guide rods are flexible contributing to unhindered cocking and uncocking of the forearm hand.

4. The device claimed in claim 3 wherein said rods are coupled to said hand retention means in a manner permitting movement of each coupled end about perpendicular axes additionally contributing to unhindered cocking movement of the forearm hand.

5. The device claimed in claim 1 wherein said elongate retention means carries a rack-like fitting engageable with said pawl to hold said retention means in a retracted state when the forearm hand is cocked.

6. The device claimed in claim 5 wherein said ratchet assembly additionally includes resilient means acting in opposite direction on said pawl to position the latter permitting unobstructed passage of the elongate retention means during cocking of the hand and thereafter positioning said pawl for engaging the rack-like fitting on said elongate retention means.

7. The device claimed in claim 5 wherein said ratchet assembly additionally includes means yieldably biasing said pawl towards said rack-like fitting, said yieldable means including a spring biased keeper, a pawl mounting pin biased by said keeper.

8. The device claimed in claim 7 wherein said yieldable means additionally includes adjustment means for varying the biasing action of said spring biased follower whereby the retentive action of said pawl on the elongate retention means may be varied.

9. The device claimed in claim 8 wherein said pawl mounting pin is yieldably mounted within said ratchet assembly.

* * * * *